US005329225A

United States Patent [19]

Roshen et al.

[11] Patent Number: 5,329,225

[45] Date of Patent: Jul. 12, 1994

[54] THIN FILM SUPERCONDUCTOR INDUCTOR WITH SHIELD FOR HIGH FREQUENCY RESONANT CIRCUIT

[75] Inventors: Waseem A. Roshen, Clifton Park; Antonio A. Mogro-Campero, Schenectady; James W. Bray, Schenectady; Charles S. Korman, Schenectady, all of N.Y.

[73] Assignee: General Electric Co., East Windsor, N.J.

[21] Appl. No.: 970,515

[22] Filed: Nov. 2, 1992

[51] Int. Cl.[5] ..... H01F 7/22

[52] U.S. Cl. ..... 323/360; 323/351; 333/99 S; 336/200; 336/DIG. 1; 505/870; 505/880

[58] Field of Search ..... 333/99 S; 336/DIG. 1, 336/200; 323/360; 307/306; 363/13; 505/870, 880; 335/216

[56] References Cited

U.S. PATENT DOCUMENTS

| | | | |
|---|---|---|---|
| 4,032,959 | 6/1977 | Boom et al. | 323/44 |
| 4,920,011 | 4/1990 | Ogawa et al. | 428/596 |
| 4,968,961 | 11/1990 | Miyajima et al. | 335/216 |
| 4,981,838 | 1/1991 | Whitehead | 505/1 |
| 5,168,259 | 12/1992 | Takemura | 505/870 |
| 5,219,827 | 6/1993 | Higaki et al. | 505/1 |
| 5,231,078 | 7/1993 | Riebman et al. | 505/1 |

FOREIGN PATENT DOCUMENTS

| | | | |
|---|---|---|---|
| 0299116 | 7/1987 | European Pat. Off. | H04R 9/02 |
| 0300556 | 7/1988 | European Pat. Off. | H01F 27/24 |
| 0306287 | 8/1988 | European Pat. Off. | H01L 39/24 |
| 0455527 | 4/1991 | European Pat. Off. | H01P 7/08 |
| 1-120007 | 5/1989 | Japan | 336/DIG. 1 |
| 2-198107 | 8/1990 | Japan | 336/DIG. 1 |
| 1004178 | 9/1965 | United Kingdom . | |

*Primary Examiner*—William H. Beha, Jr.
*Attorney, Agent, or Firm*—W. H. Meise; C. A. Berard; S. A. Young

[57] ABSTRACT

An inductor uses high temperature superconductors in order to obtain high Q for high frequency operation. The superconductors are applied as thin films to substrates. In some embodiments, superconductor thin films are applied to opposite sides of the same substrate. Superconductive thin films are applied outside the magnetic field establishing superconductive thin films in order to shield against leakage of the magnetic field beyond the inductor. The inductor is connected to a capacitor to realize a resonant circuit used in a power conversion system.

14 Claims, 3 Drawing Sheets

THIN FILM SUPERCONDUCTOR INDUCTOR WITH SHIELD FOR HIGH FREQUENCY RESONANT CIRCUIT

FIELD OF THE INVENTION

The present invention relates to inductors made with superconductors to obtain high Q (quality factor) and systems using the inductor. More specifically, the present invention relates to an inductor useful for resonant circuits in various power conversion systems at frequencies of at least one MHz.

BACKGROUND OF THE INVENTION

Various power conversion systems have been used over the years. Among such power conversion systems, converters are used to convert DC (direct current) to DC, whereas inverters are used for converting DC to AC (alternating current). Radio frequency power amplifiers perform high frequency power conversion by using a RF (radio frequency) input and a DC input to provide a RF output with a significantly higher power than the RF input.

In order to reduce the size of such power converters, power conversion frequencies have been pushed into the MHz range. The size reduction is primarily due to the smaller size of passive magnetic components as the frequency is increased. Currently, the power densities are of the order of 50–100 Watts/in$^3$. Further improvement power densities (>200 Watts/in$^3$) is required for the upcoming high performance electronic systems such as massively parallel supercomputers. For higher power densities, it is advisable to consider frequencies in 10–1000 MHz range. The circuit topologies for such high frequency power conversion are of the resonant type. The resonant inductor used in such designs is the most critical passive component. Specifically, high circulating currents greatly stress the inductor. Thus the inductor requires a very high quality factor, of the order of 1000.

It has been difficult, if not impossible, to fabricate an inductor having the necessary characteristics for such high frequency power conversion applications using normal metallic conductors such as copper. Specifically, the skin effect causes currents to flow essentially at the surface of conductors at higher frequencies. The relatively high surface resistance of normal conductive metals such as copper tends to reduce the Q of the inductor. As the frequency gets higher, the current is even more concentrated at the surface corresponding effectively to a reduction in the cross-sectional area through which the current may flow such that the resistance is increased further.

OBJECTS OF THE INVENTION

Accordingly, it is a primary object of the present invention to provide an improved inductor.

A further object of the present invention is to provide a system using the improved inductor.

A more specific object of the present invention is to provide an inductor which uses superconductors to obtain high Q and high current-carrying capabilities.

Yet another object of the present invention is to provide an inductor which is well-shielded against emissions.

A further object of the present invention is to provide a system using the inductor as part of a resonant circuit with a capacitor to allow operation at relatively high operating frequencies of at least one MHz and, more specifically, in the range of 10 to 1,000 MHz.

SUMMARY OF THE INVENTION

The above and other objects which will become apparent when the following detailed description is read in conjunction with the accompanying drawings are realized by an inductor having conductive first and second outer layers. A first inner layer is disposed between the first and second outer layers. The first inner layer has a magnetic field establishing first active conductor portion separated from both of the first and second outer layers. The first active conductor portion is made of superconductor material which has a critical temperature greater than 30° K. First and second external inductor leads (leads connected and positioned for connection of other circuit components) are on the inductor. There is a continuous conductor path from the first lead to the second lead and the first active conductor portion is part of the continuous conductor path. The path is a continuous conductor path in that electric current may flow from one end of the path to the other, while remaining on conductive material.

The inductor is combined with a capacitor having two external capacitor leads, one of the capacitor leads connected to one of the inductor leads such that the inductor and capacitor form a resonant circuit having a resonant frequency of at least one MHz, and, more specifically, at least 10 MHz.

Some embodiments of the present invention include a second inner layer having a magnetic field establishing second active conductor portion separated from both of the first and second outer layers. The second active conductor portion is made of a superconductor material which has a critical temperature greater than 30° K. The second active conductor portion is part of the continuous conductor path. A conductive first-to-second interlayer connection electrically connects the first and second active conductor portions. The first-to-second interlayer connection is part of the continuous conductor path. In a first of these embodiments, each of the first and second active conductor portions is a coil. In a second embodiment, each of the first and second outer layers includes a conductor portion which is made of superconductor material having a critical temperature greater than 30° K. These conductor portions of the outer layers are part of the continuous conductor path in this embodiment and the outer layers serve as shields limiting magnetic fields established by the inductor to between the first and second outer layers (In other words, the magnetic fields are "limited" to that zone in the sense that at least 95% of the energy from the magnetic fields which are established is stored between the first and second outer layers. More preferably, at least 99% of the stored energy is within that zone.)

In the first embodiment mentioned above and in a third embodiment, the outer layers serve as shields limiting magnetic fields established by the inductor to between the first and second outer layers. Unlike in the second embodiment, the shields are isolated from the continuous conductor path. The first active conductor in the third embodiment is a planar, straight strip.

The inductor may further include first and second substrates with the first substrate disposed between the first outer layer and the first inner layer and the second substrate disposed between the second outer layer and the first inner layer. The first active conductor portion is a thin film disposed on one of the first and second substrates. Each of the first and second outer layers and first inner layer is planar and parallel to the others of the first and second outer layers and first inner layer. The critical temperature is more preferably higher than 70° K. and the superconductor material has a critical current density of at least $10^5$ A/cm$^2$, more preferably at least $10^6$ A/cm$^2$.

The system of the present invention includes the inductor with one of its leads attached to a lead of a capacitor in order to form a resonant circuit having a resonant frequency of at least one MHz and, more specifically, at least 10 MHz. In a first embodiment of the system, the resonant circuit is part of a DC to DC converter. In a second embodiment of the system, the resonant circuit is part of an RF amplifier. In a third embodiment of the system, the resonant circuit is part of an inverter which converts DC into AC.

BRIEF DESCRIPTION OF THE DRAWINGS

The above and other features of the present invention will be more readily understood when the following detailed description is considered in conjunction with the accompanying drawings wherein like characters represent like parts throughout the several views and in which.

DETAILED DESCRIPTION

Figure 1:
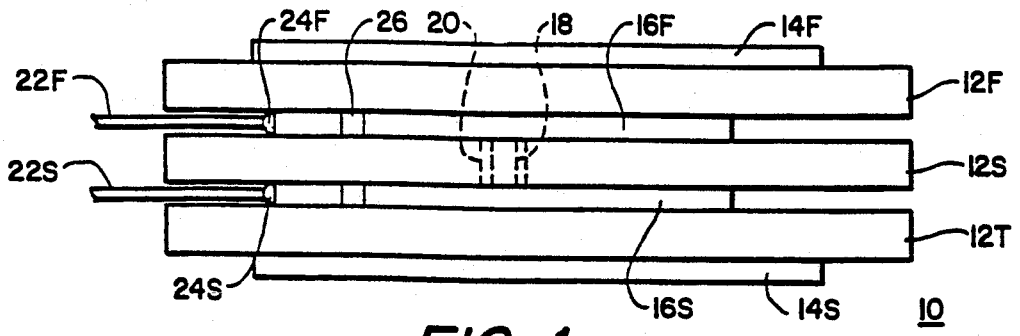
FIG. 1 shows a side view of a first embodiment inductor according to the present invention.

FIG. 1 shows a first embodiment inductor 10 according to the present invention. The inductor 10 includes first, second, and third substrates 12F, 12S, and 12T respectively. Although other materials could be used, each of the substrates preferably is composed of $LaAlO_3$. Other materials having a relatively low dielectric constant and a structure compatible with a thin film superconductor as described below could be used for the substrates. Each of the substrates is preferably between 20 and 100 mils, this corresponding to a range of 0.0508 centimeters and to 0.254 centimeters. More preferably, the substrates will each have a thickness of about 30 mils, corresponding to 0.0762 centimeters.

First and second outer layers 14F and 14S respectively are disposed respectively upon substrates 12F and 12T. Each of the thin films 14F and 14S are made of a high temperature superconductor and serve as shielding to contain fields within the relatively small volume between the parallel, planar thin films 14F and 14S .

Disposed between substrates 12F and 12S is a first inner layer 16F. The first inner layer 16F is a thin film of superconductor applied in a pattern to one of the opposing surfaces of substrates 12F and 12S. In the view of FIG. 1, the thin film inner layer 16F would either be applied to the lower surface of substrate 12F or to the upper surface of substrate 12S. In similar fashion, a second inner layer 16S of thin film superconductor is disposed between substrates 12S and 12T and deposited upon one of the opposing surfaces of those two substrates. Preferably, the thin film inner layers 16F and 16S are both deposited to the substrate 12S. Each of the layers 16F and 16S may be considered to be an active layer having a magnetic field establishing active conductor portion made of superconductive material. As used herein, such a magnetic field establishing active conductor portion is a conductive portion of an inductor to which current is applied in order to generate the magnetic field of the inductor. Thus, since outer layers 14F and 14S do not have current applied to them to establish magnetic fields, the outer layers 14F and 14S are not magnetic field establishing active conductor portions as used herein.

As shown in FIG. 1, a via hole 18 extends through substrate 12S and has a conductive first-to-second interlayer via connection 20 connecting the first inner layer 16F to the second inner layer 16S. Basically, each of the layers 16F and 16S are turns of the inductor 10 and the turns are connected in series by the connection 20. The connection 20 would preferably be a thin film of the same superconductor used for layers 16F and 16S, although other conductors, including conductors which are not superconductive, might be used as well.

External inductor leads 22F and 22S are respectively connected to layers 16F and 16S by way of respective gold portions 24F and 24S. The gold portions 24F and 24S, which may be deposited to the side of the thin film superconductor 16F and 16S as shown or deposited completely or partly on top of the thin films, are used so that the leads 22F and 22S may be welded to them for electrical connection to the thin films. As shown, there is a continuous conductor path from lead 22F to lead 22S, which continuous conductor path includes gold portions 24F and 245, thin film first and second inner layers 16F and 16S, and connection 20 .

Figure 2A:
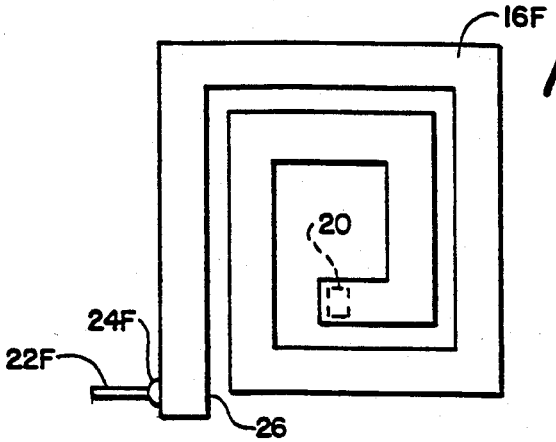
FIG. 2A shows a thin film pattern which may be used with the inductor of FIG. 1.

With reference now to FIG. 2A, the pattern of thin film inner layer 16F is shown as a rectangular spiral pattern having two turns separated by a space 26. In actual practice, one may use three, four, five, or possibly more turns. The pattern of thin film inner layer 16S may be identical to that shown for 16F in FIG. 2A and the layers 16F and 16S would have their patterns in registry, meaning that, if the pattern corresponding to 16S was added to FIG. 2A, it would simply consist of phantom lines directly below the corresponding lines in the pattern of layer 16F as illustrated. Both layers 16F and 16S would be planar and parallel.

Figure 2B:
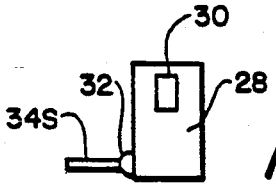
FIG. 2B shows a thin film pattern which may be used opposite to the pattern of FIG. 2A.

As an alternative to having-both inner layers constructed with the same pattern, one of the inner layers could be constructed like the pattern shown for layer 16F of FIG. 2A, whereas the other inner layer could be constructed as a strip 28 disposed on the opposite side of a substrate (not shown) from the inner layer 16F and connected to the inner layer 16F by a connection 30 (constructed like connection 20 of FIGS. 1 and 2A). The strip 28, which may be made of superconductor or a conductor which is not superconductive, is connected by gold portions 32 to an external lead 34S. Since the strip 28 is used in combination with components 30, 32, and 34S to carry away current from a rectangular spiral pattern such as shown for inner layer 16F of FIG. 2A, the strip 28 need not be made of superconductive material. The via connection 30 of FIG. 2B would be connected to a pattern such as inner layer 16F at the location shown for the via connection 20 in FIG. 2A.

Figure 3:
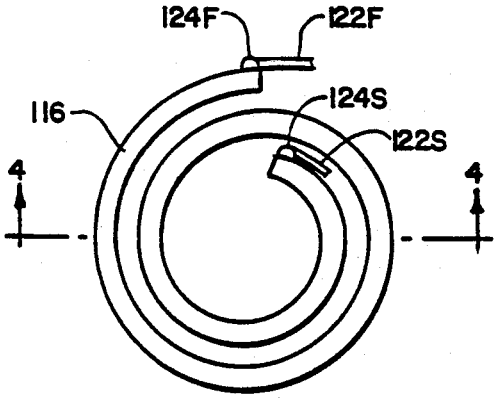
FIG. 3 shows a thin film pattern used with a second embodiment inductor according to the present invention.
Figure 4:
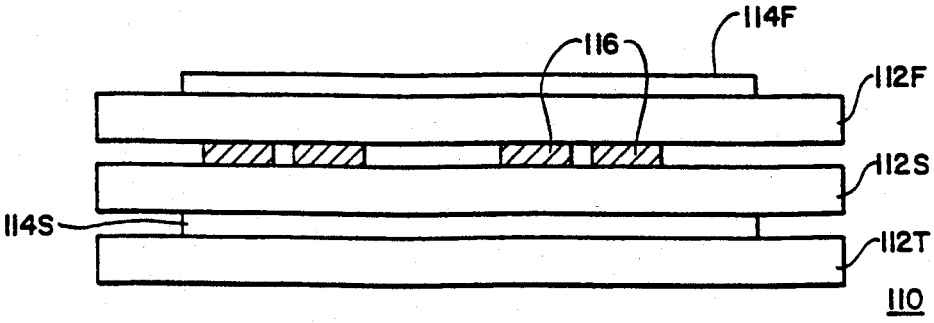
FIG. 4 shows a side view of the second embodiment inductor.

FIG. 3 shows a superconductive thin film pattern inner layer 116 which may be used in a second embodiment inductor 110 shown more completely in FIG. 4. In the second embodiment inductor of FIGS. 3 and 4, each component has numbers in the "100" series with the same last two digits as the corresponding component in the embodiment of FIGS. 1 and 2A. Thus, substrates 112F, 1125, and 112T are constructed like the substrates 12F, 12S, and 12T of FIG. 1. First and second outer layers 114F and 114S are thin film superconductors applied respectively to substrates 112F and 112T. Layers 114F and 114S are shields like those of FIG. 1. As with the embodiment of FIG. 1, the shield layers 114F and 114S extend beyond the outer—9 edges of the inner layer 116 so as to insure complete shielding of the magnetic fields established by the inner layer 116. The inner layer 116 is a thin film superconductor disposed upon the middle substrate 112S. For ease of illustration, only the inner layer 116 is shown in cross section in FIG. 4, corresponding to the cross section taken along lines 4—4 of FIG. 3. External leads 112F and 112S (FIG. 3 only) are used for making connections with the inductor 110. Gold portions 124F and 124S may be used as interfaces between the layer 116 and external leads 122F and 1225. The external lead 122S may include an insulated portion (not separately shown) so that it may proceed across one of the turns in the spiral pattern of inner layer 116. As an alternative, the inner end of the spiral inner layer 116 could have an external lead connected to it by way of an arrangement like that of FIG. 2B with a strip similar to 28 of FIG. 2B on the side of substrate 112S opposite two layer 116. In that case, the outer shielding layer 114S would have to be disposed on the outside layer of substrate 112T instead of on the inner surface of substrate 112T (i.e., the position illustrated in FIG. 4). As an alternative to having the external lead 122S proceed across part of the spiral of inner layer 116, the external lead 122S could simply wind in between the two turns of the spiral inner layer 116.

Although FIG. 3 shows the spiral 116 having only two turns, it should be appreciated that in practice three, four, five, or possibly more turns would be used. It will also be appreciated that two of the circular spirals such as inner layer 116 could be mounted on opposite sides of a substrate (not illustrated) and connected in series by a via connection in similar fashion to that discussed above with respect to the rectangular spirals of inner layers 16F and 16S in FIG. 1.

Figure 5:
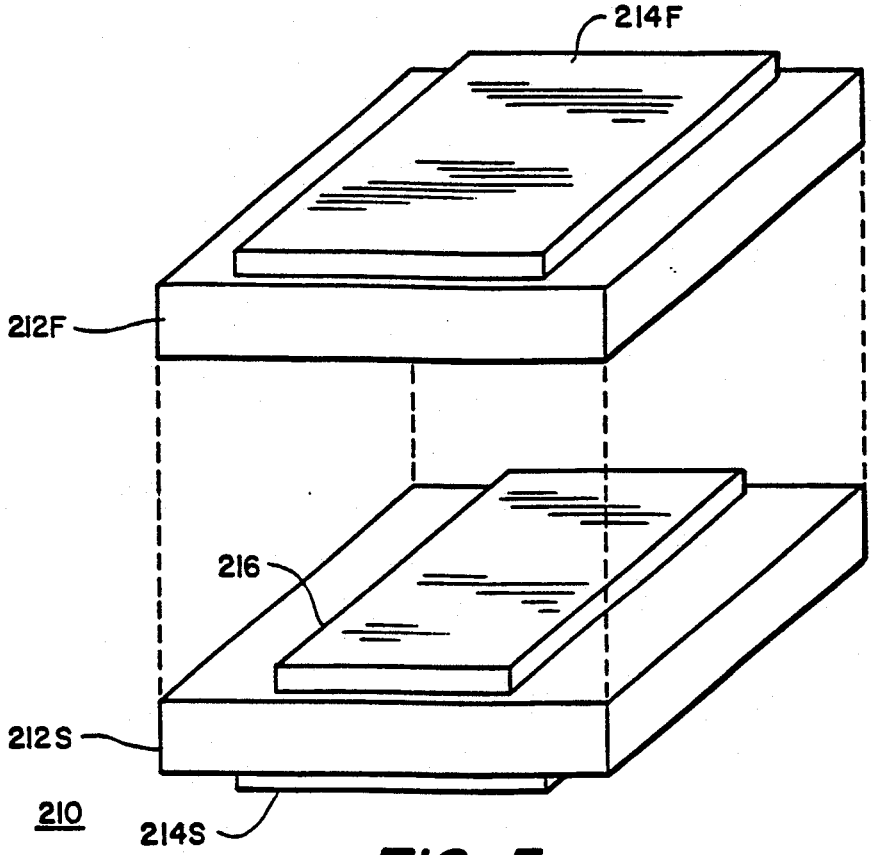
FIG. 5 shows an exploded perspective view of a third embodiment inductor.

FIG. 5 shows a third embodiment inductor 210 accordingly to the present invention. In the FIG. 5 embodiment, components are in the "200" series with the same last two digits as the corresponding component in the FIG. 1 embodiment. The inductor 210 includes substrates 212F and 212S respectively having shielding outer layers 214F and 214S. The substrates and outer layers are constructed as discussed with respect to the corresponding components of FIG. 1. The inductor 210 is different from the FIG. 1 embodiment in that the inner layer 216 is simply a thin film strip of superconductor to which external leads (not shown) would be connected to opposite ends using the techniques described above. The current through the inner layer 216 establishes a magnetic field which would be confined within the outer layers 214F and 214S. The arrangement of inductor 210 is somewhat similar to a microstrip-line configuration.

Figure 6:
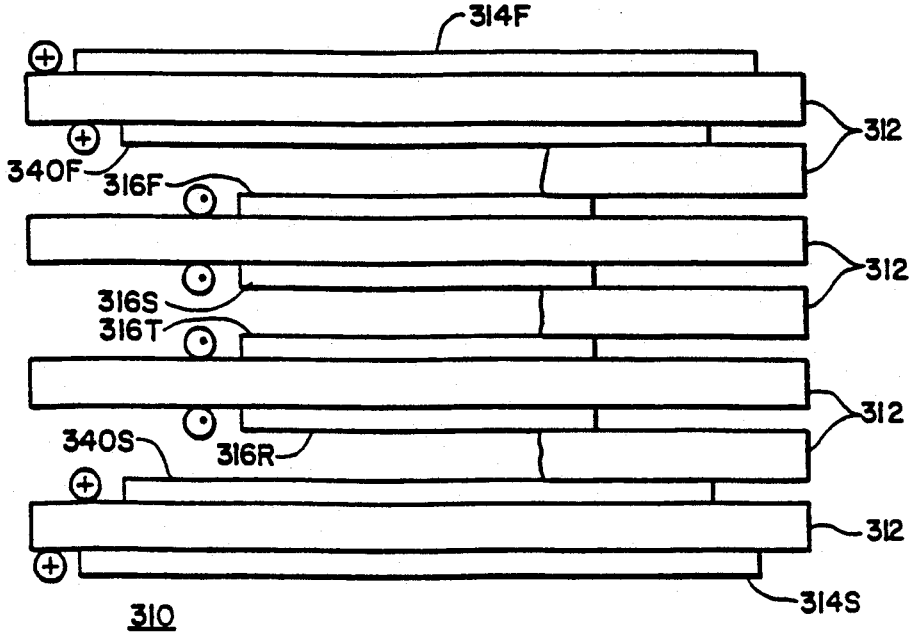
FIG. 6 shows a side view of a fourth embodiment inductor with portions of some substrates broken away.
Figure 7:
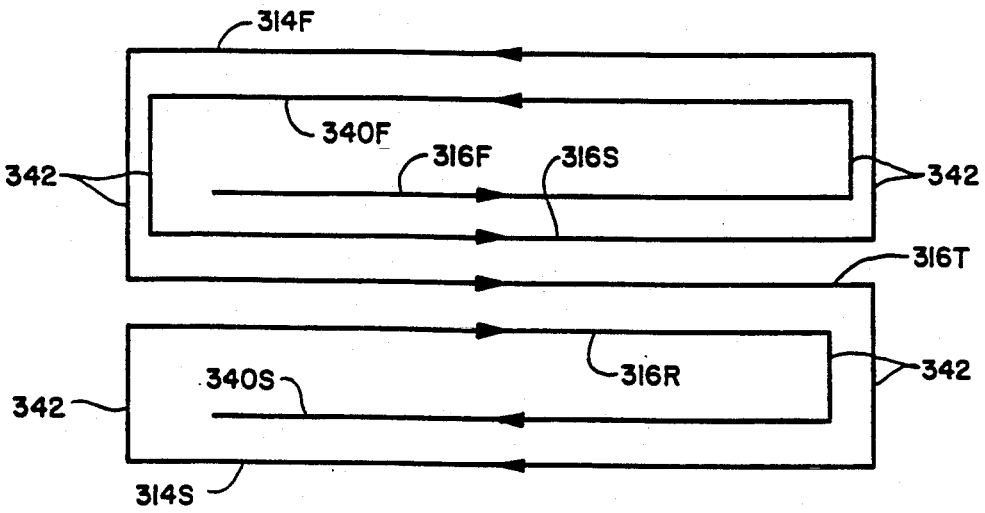
FIG. 7 is a schematic illustrating current flow in the inductor of FIG. 6.

FIG. 6 shows a fourth embodiment inductor 310 and has components in the "300" series with the same last two digits as the corresponding components in the FIG. 1 embodiment. The inductor 310 has a relatively large number of substrates which are simply labeled 312. All of the substrates may be identical in size and rectangular shape. However, for ease of illustration every other substrate has been shown with its left portion broken away. Shielding thin film superconductor outer layers 314F and 314S are used as conduits for the applied current as well as shields in the arrangement of FIG. 6. Intermediate thin film superconductor layers 340F and 340S are deposited on the outer substrates 312, whereas first, second, third, and fourth inner superconductor thin film layers 316F, 316S, 316T, and 316R are disposed on various of the substrates 312 as illustrated. With reference now also to FIG. 7, the inductor 310 serves as a flat version of the co-axial transmission line. Note also that the left side of FIG. 6 shows plus symbols adjacent those superconductor layers in which current is flowing out of the plane of view of FIGS. 6 and dot symbols for those thin film superconductor layers in which current is flowing into the plane of view of FIG. 6. FIG. 7, which shows a view from a right side 90° to the view of FIG. 6, shows how various end connectors 342 are used to link the various thin film superconductor layers in a pattern such that current flows from 316F to 340F to 316S to 314F to 316T to 314S to 316R to 340S. The arrangement of FIG. 6 and 7 is a four turn inductor. For ease of illustration, the external leads are not shown in FIGS. 6 and 7, but external leads would be used and connected to layers 316F and 340S using the same techniques discussed above.

In the arrangement of FIG. 6, the various thin film superconductor layers are disposed upon opposite sides of every other one of the substrates 312. In other words, each of the substrates 312 which has one thin film superconductor layer on it has another such layer on the opposite side. Further, every other substrate 312, corresponding to those substrates 312 which are only partially illustrated, have no thin film superconductor layers on them. If desired, these last mentioned substrates 312 could be replaced with some alternate insulation such as a Kapton layer deposited on top of the thin film which is to be insulated.

Thin film superconductors used for the various inductor designs discussed would preferably be made of YBa2Cu307(YBCO). These have been shown to have a surface resistance at 10 GHz and 77° K. which is orders of magnitude below that of copper. In general, other high temperature superconductor systems such as the thallium and bismuth systems are applicable to various embodiments of this invention. The relative advantage of superconductors over regular conductors increases at lower frequencies.

In fabricating the inductor, various methods of depositing the thin film of superconductor may be used. A preferred technique is evaporation, which is suitable to two-sided deposition so as to minimize the number of substrates needed. The YBCO thin films would be co-evaporated and post-annealed using known techniques. Since deposition is at ambient temperature onto rotating plates, large area and double sided deposition is simplified.

The preferred range of thicknesses for the various superconductive thin films is between 4,000 and 8,000 Angstroms. A preferred thickness would be about 6,000 Angstroms. As used herein, a thin film has a thickness of about 6,000 Angstroms.

The various thin film superconductors used with the present invention should be high temperature superconductors having a critical temperature of greater than 30° K. and, more preferably, having a critical temperature higher than 70° K.

The Q of the inductor made using the present techniques should be higher than 400 and, more preferably, between 5,000 and 10,000. Although various inductance values may be obtained, an inductance of 0.2 microHenrys may be obtained.

Since the inductor of the present invention is to be employed in a high power application, the superconductor must be able to handle high currents without reverting to the normal state. The thin film superconductor should have a critical current density of at least $10^5$A/cm2, and more preferably a current density higher than $10^6$A/cm2. The inductors constructed using the present techniques should be able to handle currents of 10 to 12 amps, although lower and higher maximum currents might occur in some inductors. The power handling capabilities of inductors according to the present invention should be at least 10 watts and, more specifically, at least 100 watts. Even more specifically, the power handling capabilities should be 10–1000 watts.

Figure 8:
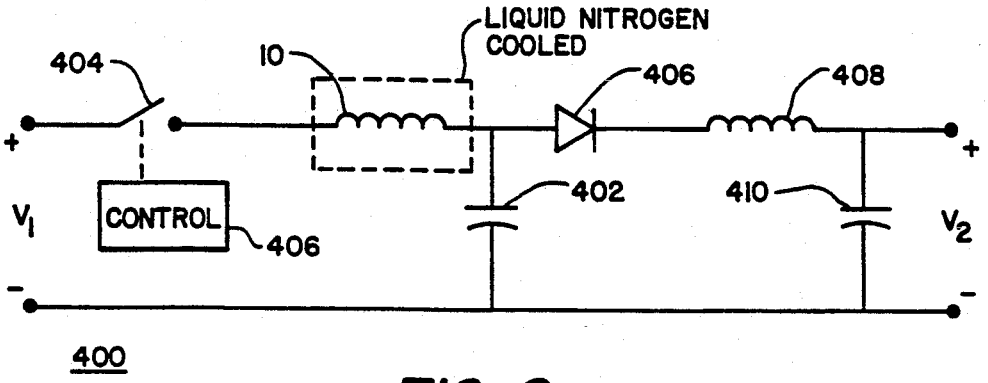
FIG. 8 is a schematic of a first embodiment system of the present invention.

Turning now to FIG. 8, a system 400 according to the present invention uses the inductor 10 in combination with capacitor 402 in order to realize a parallel LC resonant circuit. Specifically, one of the external leads (not separately shown in FIG. 8) would be connected to a corresponding external lead, either directly or by way of intermediate wiring, of the capacitor 402. As illustrated, the inductor 10 would be cooled by liquid nitrogen in order to achieve the superconductive effect. The resonant circuit of inductor 10 and capacitor 402 would be used for DC to DC conversion in the system 400. In particular, an input switch 404 is controlled by control 406 to open and close at a frequency around the resonant frequency of the resonant circuit. Known techniques may be used for control of the switch 404, which is preferably a high power FET. At the output of the resonant circuit, a diode 406 is used for rectification, whereas an output inductor 408 and output capacitor 410 are used for filtering. The system 400 uses the inductor 10 (or any of the other inductors according to the present invention as discussed above) for converting an input DC voltage V1 into an output DC voltage V2.

Since liquid nitrogen or other low temperature cooling equipment is required for the inductor 10, the inductor 10 (and the other inductors made according to the present invention) is especially well suited to operate in a larger system where low temperature equipment is already in place. Among such systems are magnetic resonance imaging systems (where low temperature is needed for the superconducting magnet coils), infrared detector systems which use cooled materials such as semiconductors, cryogenic electronics, and space applications. The inductors according to the present invention may also be used in some high end computers where a form of liquid cooling is already provided. Under some circumstances, the inductors according to the present invention may be useful in systems which would not otherwise have liquid cooling. In that case, liquid cooling would have to be provided solely for use by the inductor.

In the arrangement of FIG. 8, the resonant inductor 10 is used to shape the current and voltage wave forms so as to reduce by a large factor the high frequency voltage and/or current stresses on the switch 404. In the absence of the resonant inductor, the high frequency stresses on the primary switch 404 could become formidable. The resonant inductor 10 makes the high frequency power converter 400 possible.

Other high frequency converters (not shown) could use more than one resonant-type inductor. For example, one of the resonant inductors could be used as part of a tuned rectifier.

Figure 9:
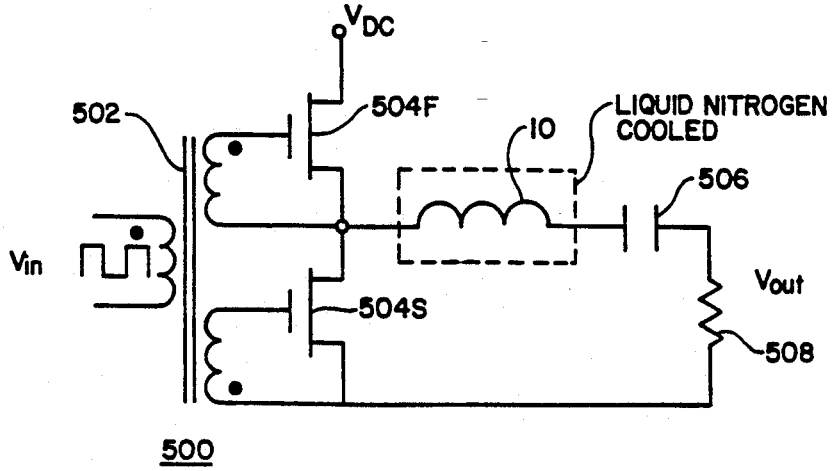
FIG. 9 is a schematic of a second embodiment system according to the present invention.

With reference now to FIG. 9, an inductor 10 (or other inductor according to the present invention) may be used in a system 500. The system 500 is a known design for a RF power amplifier and input RF voltage Vn is supplied to a transformer 502 having first and second semiconductor switches 504F and 504S connected to different secondaries of the transformer 502. A series LC circuit including inductor 10 and a capacitor 506 are connected between the transformer 502 and the load 508 to which an amplified RF signal is applied as voltage Vout. A DC voltage VDc is applied to FET switch 504F. The system 500 can, in addition to its use as an RF power amplifier, be used as a high frequency inverter to convert the voltage VDc into an AC signal Vout.

Although various specific constructions have been described herein, it is to be understood that these are for illustrative purposes only. Various modifications and adaptations will be apparent to those of skill in the art. Accordingly, the scope of the present invention should be determined by reference to the claims appended hereto.

What is claimed is:

1. An inductor comprising: a conductive first outer layer; a conductive second outer layer; a first inner layer in between said first and second outer layers, said first inner layer having a magnetic field establishing first active conductor portion separated from both of said first and second outer layers, said first active conductor portion being made of superconductor material which has a critical temperature greater than 30° K.; first and second external inductor leads; and wherein there is a continuous conductor path from said first lead to said second lead, said first active conductor portion being a part of said continuous conductor path.

2. The inductor of claim 1 wherein said critical temperature is higher than 70° K. and said superconductor material has a critical current density of at least $10^5$A/cm2.

3. The inductor of claim 1 further comprising a second inner layer between said first and second outer layers, said second inner layer having a magnetic field establishing second active conductor portion separated from both of said first and second outer layers, said second active conductor portion being made of superconductor material which has a critical temperature greater than 30° K. and being a part of said continuous conductor path and a conductive first-tosecond interlayer connection electrically connecting said first and second active conductor portions, said first-to-second interlayer connection being a part of said continuous conductor path.

4. The inductor of claim 3 wherein each of said first and second active conductor portions is a coil.

5. The inductor of claim 3 wherein each of said first and second outer layers is part of said continuous conductor path, and wherein said first and second outer layers are shields limiting magnetic fields established by the inductor to between said first and second outer layers.

6. The inductor of claim 3 wherein said first and second outer layers are shields limiting magnetic fields established by the inductor to between said first and second outer layers, said shields isolated from said continuous conductor path.

7. The inductor of claim 6 wherein each of said shields is made of superconductor material which becomes superconductive at a critical temperature greater than 30° K.

8. The inductor of claim 1 wherein said first and second outer layers are shields limiting magnetic fields established by the inductor to between said first and second outer layers, said shields isolated from said continuous conductor path and wherein said first active conductor is a planar, straight strip.

9. The inductor of claim 1 further comprising first and second substrates, said first substrate disposed between said first outer layer and said first inner layer, and said second substrate disposed between said second outer layer and said first inner layer, and wherein said first active conductor portion is a thin film disposed on one of said first and second substrates.

10. The inductor of claim 9 wherein each of said first and second outer layers and first inner layer is planar and parallel to the others of said first and second outer layers and first inner layer.

11. A system comprising:

an inductor having first and second external inductor leads with a continuous conductor path between them, said continuous conductor path including a first inner layer having a magnetic field establishing first active conductor portion, said first active conductor portion being made of a superconductive material which has a critical temperature greater than 30° K.; and a capacitor having two external capacitor leads, one of said capacitor leads connected to one of said first and second external inductor leads, wherein said inductor and said capacitor form a resonant circuit having a resonant frequency of at least 1 MHz; and first and second outer layers limiting magnetic fields established by said inductor to a region lying between said first and second outer layers, said first and second outer layers being made of superconductor material which has a critical temperature greater than 30° K.

12. The system of claim 11 wherein said resonant frequency is at least 10 MHz.

13. The system of claim 12 wherein said inductor further includes first and second substrates, said first substrate disposed between said first outer layer and said first inner layer, and said second substrate disposed between said second outer layer and said first inner layer, and wherein said first active conductor portion is a thin film disposed on one of said first and second substrates.

14. A resonant circuit, comprising:

an inductor including (a) a conductive first outer layer; (b) a conductive second outer layer; (c) a first inner layer in between said first and second outer layers, said first inner layer having a magnetic field establishing first active conductor portion separated from both of said first and second outer layers, said first active conductor portion being made of superconductor material which has a critical temperature greater than 30° K.; (d) first and second external inductors leads; e) and wherein there is a continuous conductor path from said first lead to said second lead, said first active conductor portion being a part of said continuous conductor path, and a capacitor having two external capacitor leads, one of said capacitor leads connected to one of said first and second external inductor leads, wherein said inductor and said capacitor form a resonant circuit having a resonant frequency of at least 1 MHz.

* * * * *